US005397605A

United States Patent [19]

Barbieri

[11] Patent Number: 5,397,605

[45] Date of Patent: Mar. 14, 1995

[54] METHOD AND APPARATUS FOR ELECTROSTATICALLY COATING A WORKPIECE WITH PAINT

[76] Inventor: Girolamo Barbieri, Via Montello, 10 - 22069, Rovellasca (Como), Italy

[21] Appl. No.: 63,260

[22] Filed: May 18, 1993

[30] Foreign Application Priority Data

May 29, 1992 [IT] Italy ..... MI92A01323
Apr. 29, 1993 [IT] Italy ..... MI93A0847

[51] Int. Cl.[6] ..... B05D 1/12

[52] U.S. Cl. ..... 427/485; 427/180; 427/475; 427/486; 239/3; 239/8; 239/429; 239/690; 239/704; 239/706

[58] Field of Search ..... 427/475, 485, 486, 180; 239/3, 8, 429, 690, 704, 706

[56] References Cited

U.S. PATENT DOCUMENTS 4,759,500 7/1988 Hoffman et al. ..... 427/475

FOREIGN PATENT DOCUMENTS 0199054 10/1986 European Pat. Off. .
0268211 5/1988 European Pat. Off. .
3925476 3/1990 Germany .
540066 9/1973 Switzerland .

*Primary Examiner*—Michael Lusignan
*Assistant Examiner*—David M. Maiorana
*Attorney, Agent, or Firm*—Laff, Whitesel, Conte & Saret, Ltd.

[57] ABSTRACT

In a method of electrostatic painting, the air to be conveyed towards the spraying nozzle (10) of a gun (9) together with the powdered paint, is enriched with at least one additive gaseous fluid consisting of at least one gas supplied from a feeding bottle (136, 137, 138, 139) and/or vapor obtained by submitting the air to bubbling through a working liquid (115). The additive fluid which has a greater electric conductivity than the air, causes an increase in the paint amount coated on the workpiece (11) in relation to the paint amount sprayed from the nozzle (10).

17 Claims, 3 Drawing Sheets

1
2
3
4
5
5a
6
6a
6b
6c
7
8
9
9a
10
11
12
12a
13
14
14a
15
15a
15b
16
17
18
19a
19b
20
20a
21
22
22a
23
"A"

1
2
3
4
5
5a
6
6a
6b
6c
7
8
9
9a
10
11
12
12a
13
44
114
116
116a
125
136
136a
137
137a
138
138a
139
139a
140
141
142
143
"A"

METHOD AND APPARATUS FOR ELECTROSTATICALLY COATING A WORKPIECE WITH PAINT

BACKGROUND OF THE INVENTION

1. Field of the Invention

The present invention relates to a method for electrostatically coating a workpiece with paint, comprising the following steps: mixing with air a paint in the form of a powder consisting of a plurality of particles dispersed in air; electrostatically charging the individual particles forming the powder paint by submitting the paint to an electric ionization field; projecting the electrostatically-charged powdered paint against a workpiece at the same time as said air is ejected through a spraying nozzle.

The invention also relates to an apparatus for electrostatically coating a workpiece with paint comprising: a spray gun having a spraying nozzle arranged to project a powder paint in the form of air-dispersed particles towards a workpiece; a delivery duct communicating with the spraying nozzle of the gun; air feed means for supplying air to the delivery duct; paint feed means for supplying paint to the spraying nozzle; a ionization circuit having one pole connected to at least one electrode adapted to electrostatically charge the paint particles and a second pole electrically connected to the workpiece.

In the progress of the present description reference will be particularly made to painting of workpieces by electrostatic coating of same with paints in the form of dry powders, that is in the absence of liquid sol vents. However, the innovatory concept envisaged by the present invention can be utilized to advantage also for electrostatic painting with the use of liquid paints to be atomized.

2. Prior Art

It is known that apparatus employed for electrostatic powder-painting are generally comprised of a container inside which the powder paint is held suspended in air by means of a fluidized bed which is created by blowing air through a filtering element laid down at the base of the container itself. Connected to the container's top portion is a Venturi-type admission valve which is operatively interposed between a feed duct, in turn connected to a compressed air feed source, and a delivery duct in turn connected to a paint spray gun. The forced passage of air through the admission valve, regulated to a predetermined flow rate, causes the powder mixed with the air held in the container to be drawn in, according to an adjustable flow rate.

The mixture consisting of air and suspended powder thus admitted to the delivery duct reaches the gun and is sprayed out of the gun itself through an appropriate spraying nozzle. Usually, disposed close to the spraying nozzle is one or more electrodes connected to the negative pole of an electric feeding circuit, in order to create an electric ionization field in close proximity to the spraying nozzle.

Under this situation, the paint particles that, together with the air stream, come out of the nozzle are electrostatically charged as they pass through a ionization field and will consequently adhere to the workpiece which is normally polarized with a sign opposite that of the particles.

It is useful to note that during this step the adhesion of the paint particles is exclusively due to electrostatic effects so that the paint layer coated on the workpiece is very delicate and can be removed or damaged very easily. The stabilization of the molecular bonds between the paint particles and the workpiece will take place only at a subsequent baking step.

The foregoing being stated, it is clear that presently electrostatic paintings carried out by the use of apparatus of the described type involve many limits and drawbacks essentially resulting from the fact that an important amount of the sprayed powder, in many cases exceeding 50%, is dispersed in the surrounding atmosphere instead of being coated on the workpiece.

Therefore the work environment where painting is executed is enclosed in appropriate spray booths with which suitable suction and filtering systems are associated for recovery of the important amounts of dispersed powder paint.

The installation of these systems, which must be capable of filtering important amounts of air in a time unit, has an important weight on the overall cost of the painting plant.

In addition, the necessity of recovering and reusing powders involves important problems each time the paint being used must be replaced by another paint of different type and/or color. In these cases, in fact, the whole painting plant needs to be stopped for several hours which are necessary to carry out the filter replacement and cleaning of all surfaces and ducts concerned with the paint passage, in order to prevent traces of the previously used paint from contaminating the new type of paint to be used.

It is well apparent that this problem represents a severe limitation to the flexibility of use of the painting plant; in fact in order to partly obviate this drawback paint replacements are usually carried out at given periods and after one type of paint has been used for several working days.

On the other hand, contrary to that which could appear at first sight, the paint coating on a workpiece cannot be improved by merely increasing the values of the electrode supply current for the purpose of improving the electrostatic-charge effects of the particles. In fact, when these current values exceed given limits, electric discharges are created between the electrodes and the workpiece and they can irreparably impair the final result.

Neither can be made attempts to increase the outflow speed of the air and particles from the spraying nozzle in order to make the particles reach the workpiece before their being dispersed in the surrounding atmosphere. In fact a too strong air stream would cause the removal of the particles coated on the workpiece, and would make the individual particles remain in the electric induction field for a shorter time.

In view of the foregoing, all attempts hitherto carried out in the art for the purpose of improving paint coating have been substantially addressed to the study of appropriate geometrical shapes and structures of the spraying nozzles and, above all, to the qualitative improvements of the electrodes and feeding circuits connected thereto. By the use of very sophisticated technologies some improvements have been achieved which, however, appear relatively small when compared to the additional costs that such technologies involve.

For example, in accordance with the most advanced and expensive construction solutions, the ionization field could be produced directly within the container inside which paint is held in suspension. The large available room makes it possible to employ a much greater number of electrodes than on the spraying nozzle of the gun. In addition, the paint particles remain for a longer time in the ionization field.

However the paint particles tend to lose their electrostatic charge during their travel from the container to the gun, along the delivery duct. Consequently, the yield increase is much lower than the expected one. In fact, when substantially flat metal surfaces are to be painted, the amount of paint dispersed in the work environment almost never lowers below 25-30%.

It is also to be pointed out that, under given situations such as in the presence of trihedron angles where undesired phenomena of magnetic interference are created, a correct paint coating is still more difficult, and sometimes even impossible. This fact gives rise to important problems, above all with reference to the modern painting plants of the automated type in which in many cases manual finishing interventions are required for executing the paint coating in those areas that can be hardly reached by paint.

Furthermore, the problems that are presently connected with the electrostatic painting make it practically impossible to use this process for paint coating manufactured articles made of a material of low conductivity, such as glass, as well as for coating additional paint layers on articles painted during a previous working step.

In accordance with the present invention, it has been found possible to solve a preponderant part of the problems of the known art if at least one additive gaseous fluid is admixed with the air conveyed to the spray gun nozzle, which additive fluid will have a greater electric conductivity than the air.

SUMMARY OF THE INVENTION

Consequently the invention relates to a method for electrostatically coating a workpiece with paint, further comprising a step of enriching the air to be conveyed to the spraying nozzle with at least one additive gaseous fluid having a greater electric conductivity than the air itself, so that the electrostatic charge induced on the paint particles by effect of the electric ionization field is increased.

In accordance with the present invention this method is put into practice by an apparatus for electrostatically coating a workpiece with paint, further comprising enrichment means for mixing at least one additive gaseous fluid with the air coming from said air feed means, which additive fluid will have a greater electric conductivity than the air itself.

BRIEF DESCRIPTION OF THE DRAWINGS

Further features and advantages will become more apparent from the detailed description of at least some preferred embodiments of a method for electrostatic coating of a workpiece with paint and the apparatus for putting said method into practice, in accordance with the present invention. This description will be given hereinafter by way of non-limiting example with reference to the accompanying drawings, in which.

DESCRIPTION OF THE PREFERRED EMBODIMENTS

Figures 1, 2:
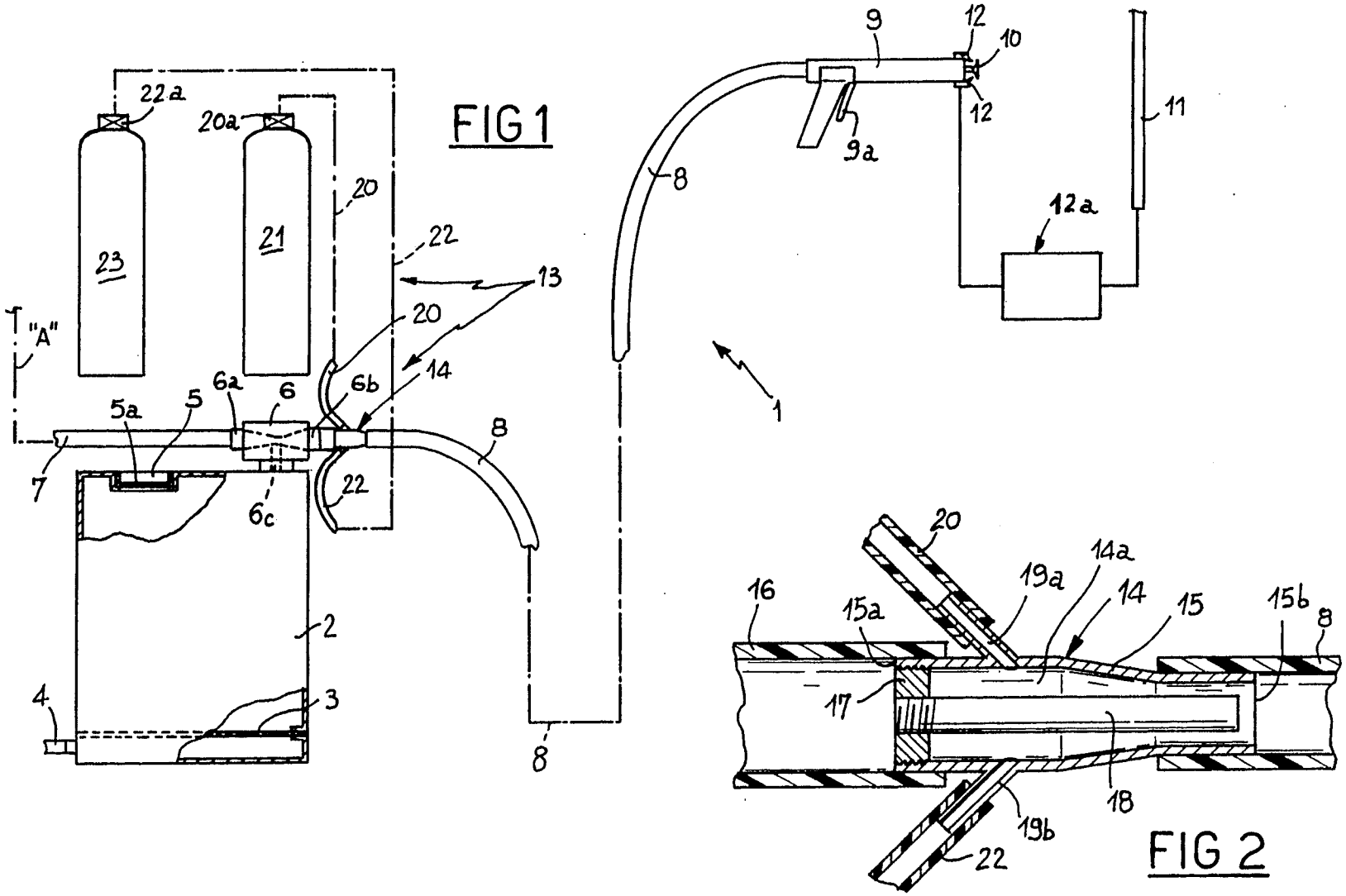
FIG. 1 diagrammatically shows an apparatus for electrostatic painting according to one embodiment of the present invention.
FIG. 2 is an enlarged sectional view of a mixing collector operatively disposed along the delivery pipe of the apparatus, according to the invention.

Referring to the drawings, an apparatus for electrostatic coating of a workpiece with paint in accordance with the present invent ion has been generally identified by reference numeral 1.

In the embodiment shown, in which a polyester-type paint in the form of dry powder is used, the apparatus 1 comprises a container 2 into which a desired amount of powder paint is introduced which consists of very fine solid particles. Close to the container 2 bottom a filtering element 3 is laid down under which an air stream of the desired flow rate is admitted through at least one admission nozzle 4 communicating, as better clarified in the following, with air feed means known per se and therefore not shown, connected to a main delivery pipeline "A".

The air introduced through the admission nozzle 4 passes through the filtering element 3 and, by effect of its upward motion is admixed with the paint particles held in the container 2 keeping them constantly suspended. An outlet opening 5 formed on top of the container 2 and provided with a respective filter **5*a* enables the excess air to escape from the container 2** so that pressure within said container is kept at a predetermined value normally marginally higher than the atmospheric pressure.

Also connected to the top portion of the container 2 is an admission valve 6 known per se, of a type the operation of which is based on the Venturi effect. In greater detail, this admission valve 6 has an inlet end portion 6a into which a feed duct 7 opens which is connected to said compressed air feed means by the main delivery pipeline "A". The valve 6 also has an outlet end portion **6*b* engaged with a delivery duct 8, as well as a feed channel 6*c* opening into the inside of container 2. The air passage from the feed duct 7 to the delivery duct 8 causes, by Ventury effect, the drawing of air and paint particles suspended in air from within the container 2**, in a metered amount proportional to the air flow rate from the feed duct itself.

The delivery duct 8 terminates at a gun 9 optionally provided with a drive lever **9*a* for opening the fluid communication with a spraying nozzle 10 through which the powder paint particles carried by the air stream are ejected from the gun itself and projected towards a workpiece 11** disposed before the gun.

It is also provided that the paint particles before reaching the workpiece 11 be submitted to an electric ionization field in the presence of which the individual particles are electrostatically charged. In the embodiment shown, the electric ionization field is produced with the aid of one or more electrodes 12 known per se and therefore only diagrammatically shown, operatively disposed at the spraying nozzle 10.

Connected to the electrodes 12 is only one pole, the negative pole for example, of an electric feeding circuit **12*a*, also known and therefore only diagrammatically shown, the other pole of which is connected to the workpiece 11**.

It is apparent from the foregoing that the apparatus in question lends itself to put into practice a method for electrostatic coating of a workpiece with paint which in known manner comprises the following steps: mixing with air a powder paint consisting of a plurality of particles dispersed in the air itself; electrostatically charging the individual particles constituting the powder paint by submitting the paint to an electric ionization field; projecting the electrostatically charged powder paint towards a workpiece, at the same time as said air is ejected through a spraying nozzle.

In accordance with the invention, it is originally provided that, by virtue of the presence of appropriate enrichment means 13, the air to be conveyed to the spraying nozzle 12 together with the paint should be enriched with at least one additive gaseous fluid means having a greater electric conductivity than the air itself, for increasing the electrostatic charge induced on the paint particles by effect of the electric ionization field.

It is noted that although the addition of this additive fluid means is a very simple operation, it leads to effects quite unexpected by a person skilled in the art. In fact, the paint particles coming out of the spraying nozzle 10 reach the workpiece 11 and adhere thereto in a remarkably improved manner as compared to the known art.

The causes of the achieved improvements cannot be easily identified. While no binding theory is wished to be advanced to the ends of the invention, it is deemed that the presence of the conductive gaseous fluid, by reducing the dielectric constant of the medium (that is the enriched air) in which the paint particles passing through the delivery duct 10 are contained, improves the characteristics of the electric ionization field produced by the electrodes 12 in terms of granting electrostatic charges to the particles themselves. In particular, the intensity of the electric ionization field produced by the electrodes 12 is greatly increased, while on the other hand no increases in the values of the supply current to the electrodes are required. In addition, due to the high conductivity of the additive fluid, the electric ionization field can be generated also backwards along the delivery pipeline 8, so that the paint particles feel its influence when they have not yet reached the gun 9.

In conclusion, the individual paint particles are submitted to a more intense ionization field, over a longer period of time than in the known art.

Obviously, the first additive gaseous fluid means employed can be of different nature depending on requirements.

Referring to the embodiment specifically shown in FIGS. 1 and 2, the first additive fluid means comprises at least one gas which is preferably admitted to the delivery pipeline 8 immediately downstream of the admission valve 6 and, therefore, immediately after introducing the paint and air particles into the delivery pipeline itself.

To this end, the enrichment means 13 provides for the employment of a mixing collector 14 comprising (FIG. 2) an outer tubular body 15 having one end 15*a* connected to the outlet end portion 6*b* of the valve 6, possibly, upon interposition of a tubular connecting length 16, as well as a second end 15*b* sealingly connected to the corresponding end of the delivery duct 8. Housed in the first end of the outer body 15 is a screw threaded element 17 operatively engaging an inner tubular body 18 extending coaxially with and along the outer body itself. One or more admission pipe fittings 19*a*, 19*b* open into the outer body 15 and they communicate with a mixing chamber 14*a* defined between the outer body 15 and inner body 18. Connected to at least one of the admission pipe fittings 19*a*, 19*b* is a feed duct 20 into which gas constituting the first additive fluid and contained in one feeding bottle 21 is introduced, through a first solenoid flow control valve 20*a* or other equivalent means operable by the lever 9*a*.

Just as an indication, it is pointed out that the best results can be achieved by employing at least one noble gas selected from the group consisting of argon, helium, krypton, neon, radon, xenon. More particularly, in a preferential solution helium gas, which is admitted in an amount included between 15 and 40 g/hour.

The ratio of the helium gas flow rate to the air flow rate is not critical to the ends of the invention but its value should preferably be in the range of 1/100 to 1/300. It has also been found that, to the ends of coating the workpiece with paint, results are further improved by carrying out also the admission of at least one second additive fluid together with the admission of the first additive fluid. For the purpose, at least one of the admission pipe fittings 19*a*, 19*b* can be connected by a second feed duct 22 provided with a second solenoid flow control valve 22*a* to a second feed bottle 23 containing a gas constituting the second additive fluid.

The addition of the second additive fluid causes an advantageous dilution of the air introduced into the delivery duct 8 and, consequently, thinning of the substances inevitably present in the air, such as free oxigen for example, that are detrimental to the electrification of the paint particles and/or coating of same on the workpiece 11.

Obviously the second additive fluid may be different type as well, depending on requirements. Just as an indication, it is pointed out that for paint coating metal articles, the best results have been achieved by adopting nitrogen gas as the second additive fluid, which is preferably admitted according to a flow rate included between 1/150 and 1/20 of the air flow rate. In greater detail, the ratio of helium flow rate to nitrogen flow rate is provided to be ½ to 1/5. Such gases are admitted according to an overall flow rate in the range of 1/100 to 1/15 of the air flow rate.

An experiment will be hereinafter described by way of example only for comparing the yield of the painting process according to the embodiment shown in FIGS. 1 and 2 with that of a painting process carried out under the same conditions in accordance with the known art, that is in the absence of additive fluids.

A metal article was first coated with paint in the absence of additive fluids. Therefore, the delivery pipeline 8 having a 11 mm diameter, was travelled over not only by paint particles but also by air the flow rate of which was 30.6 $m^3$/h. Under the above conditions, the amount of paint dispersed in the surrounding atmosphere was higher than 35%, so that the painting yield intended as percent of paint coated on the workpiece did not exceed 65% of the whole paint sprayed from the nozzle 10.

Subsequently, for operating according to the method in reference, the air flow rate through the valve 6 was partly restricted, substantially up to a value of 30 $m^3$/h. Then helium and nitrogen gas in a ratio of 1:3 and at an overall flow rate of 580 l/h have been admitted through the mixing collector 14. In greater detail, helium flow rate was 140 l/h and nitrogen flow rate was 450 l/h. It has been found that under this situation the paint loss in the surrounding atmosphere did not exceed 15%, so that the painting yield was higher than 85%.

It was also possible to increase the paint flow Pate to the delivery pipeline 8 and, as a result, the amount of paint sprayed in a time unit, thereby greatly reducing the time necessary for painting the workpiece 11.

It has also been found that the improvement of the electrostatic charge given to the paint particles by the present invention has enabled unexpected results to be achieved with reference to painting of articles made of a material having low electric conductivity, such as glass.

With reference to this material, the best results have been found to be achieved by substituting for nitrogen a gas selected from the group consisting of argon, neon and ammonium fluoride.

Figure 3:
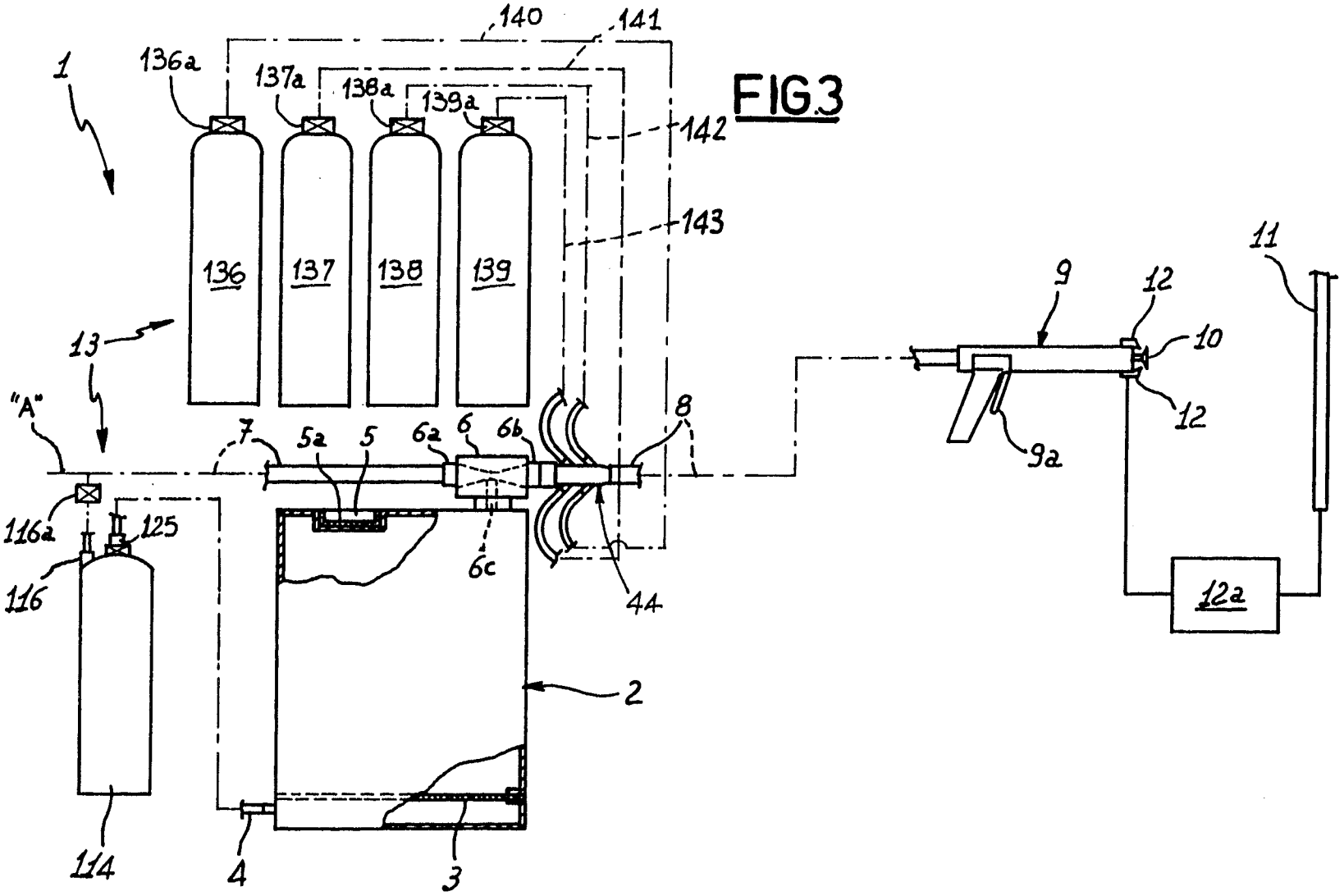
FIG. 3 diagrammatically shows a second embodiment of the invention.
Figure 4:
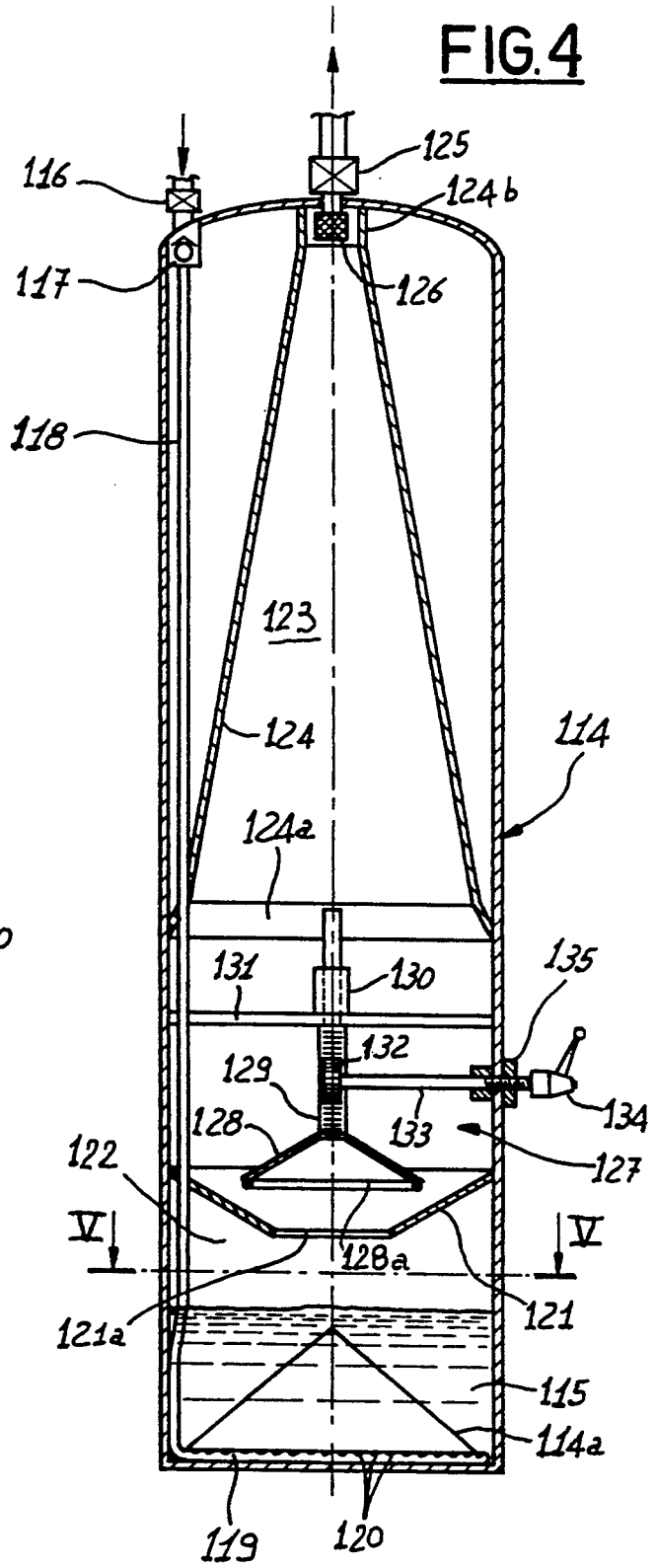
FIG. 4 is a diametrical sectional view of an enrichment device operatively associated with the air feed means of the apparatus of FIG. 3.
Figure 5:
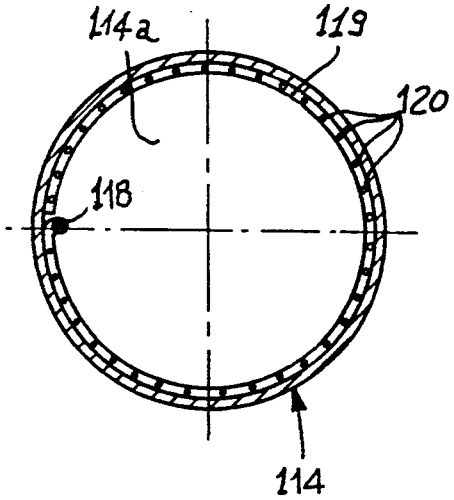
FIG. 5 is a sectional view taken along line V—V in FIG. 4.

Referring now to the embodiment shown in FIGS. 3 to 5, the first additive gaseous fluid means is generated by submitting to bubbling at least part of the air to be sent to the spraying nozzle 10 through at least one working liquid 115 designed to generate the gaseous fluid by evaporation.

To this end, the enrichment means 13 comprises at least one tank 114 preferably of cylindrical conformation and closed at the opposite ends which contains the working liquid 115 (FIG. 4).

This working liquid 115 can be selected each time depending on requirements and preferably is selected from the group consisting of lactic acid, citric acid, formaldehyde, glacial acetic acid, propionic acid, oxalic acid, monochloroacetic acid, glycolic acid, tartaric acid, sulfamic acid. In greater detail, in a preferential solution the working liquid 115 consists of a mixture of lactic acid in a range of 60% to 80% and preferably corresponding to 70%, and glacial acetic acid in a range of 20% to 40% and preferably corresponding to 30%.

Associated with the tank 114 is an inlet valve connector 116 that, as shown in FIG. 3, communicates with the air feed means through the main delivery pipeline "A", upon optional interposition of a pressure relief valve 116*a*.

As shown in FIG. 4 the inlet valve connector 116 is connected upon interposition of a nonreturn valve 117, to one end of a connecting pipe 118 extending vertically within the tank 114 and terminating at a tubular dispensing port ion 119 extending circumferentially, as clearly shown in FIG. 5, at the bottom 114*a* of the tank itself. The tubular dispensing portion 119 has a plurality of dispensing holes 120 homogeneously distributed along the extension of said portion, so that air is uniformly blown into the liquid 115, in the form of small bubbles. This solution enables the production of the first additive gaseous fluid to be conveniently increased. In fact the amount of the bubbles formed by air is sufficient to generate an important exchange surface with the working liquid 115, ensuring a sufficient evaporation of said liquid at room temperature.

Advantageously the tank bottom 114*a* has a cone-shaped conformation with its vertex turned upwardly. This expedient leads the tubular dispensing portion 119 to be always fully dipped into the working liquid 115, even when the amount of said liquid, as a result of evaporation, is greatly reduced.

Obviously appropriate signalling means may be provided for informing about the working liquid level inside the tank 114. This signalling means has not been shown, as it can be made in any known and conventional manner. In case of need the level of the working liquid 115 can be restored to the original amount by admitting new liquid through the inlet valve connector 116.

Arranged at the outside of tank 114, over the liquid level 115 is at least one restricting diaphragm 121 preferably in the form of a truncated cone converging downwardly. This restricting diaphragm defines along the tank extension, an air enrichment section 122 located at the base of said tank and a drying section 123 extending vertically over the enrichment section 122 and communicating with the latter through a central opening 121*a* exhibited by the diaphragm 121.

The presence of the diaphragm 121 in addition induces strong swirling motions in the air stream supplied to the enrichment section 122 through the liquid 115. Following these swirling motions a partial condensation of the excess vapors carried by the enriched air and falling into the liquid 115 is achieved, as well as an optimal distribution in the air of the vapors remaining in a gaseous state.

Any excess vapors still present in the enriched air will be subjected to condensate on crossing the drying section 123. This section is preferably confined to a conveying portion 124 of truncated conical form gradually narrowing upwardly and exhibiting a lower end 124*a* engaged with the inner walls of the tank 114, as well as an upper end 124*b* sealingly engaged with an outlet valve connector 125 associated at the upper part thereof with the tank itself.

In conclusion, the enriched air that, after optionally passing through a filtering element 126, reaches the outlet valve connector 125 will have a reduced percent amount of the first additive gaseous fluid substantially in the form of dry vapor, and therefore will be adapted to be sent to the spraying nozzle 10 together with the powder paint, without the risk that further condensing of the vapors forming the first additive gaseous fluid may occur.

In order to avoid the working liquid escaping from the outlet valve connector 195 the presence of closing means 127 is also provided, which means can be selectively actuated for hermetically isolating the enrichment section 122 from the drying section 123 so as to prevent the working liquid 115 from flooding the drying chamber should the tank 114, during transportation or storage, be disposed horizontally. In the embodiment shown, the closing means 127 comprises at least one closing element 128 fastened to the lower end of a rack-like rod 129 slidably engaged in a vertical direction through a guide element 130 supported by one or more radial crosspieces 131 fastened to the inner part of tank 114.

The rack-like rod 129 is acted upon by a sprocket 132 keyed to the end of a drive rod 133 rotatably engaged in the tank 114 and emerging laterally therefrom. Fastened to the end of the drive rod 133 externally of the tank 114 is a drive lever 134 through which the closing element 128 can be selectively moved between a closure condition in which it acts by means of a seal 128*a* on the restricting diaphragm 121 for closing the fluid communication between the enrichment section 122 and drying section 123 and an opening condition in which, as shown in FIG. 4, said closing element 128 is moved apart from the restricting diaphragm for opening said fluid communication.

A locking ring 135 operatively engaged on a threaded portion 133*a* of the drive rod 133 lends itself to be manually operated for locking the drive rod in the rotational direction and consequently the closing element 128 in the desired position.

In the embodiment shown the outlet valve connector 125 is connected to the admission nozzle 4 located at the base of the container 2, so that the enriched air is utilized to keep the powder paint in a suspended condition in the container itself. In this case part of the first additive gaseous fluid will be evacuated to the outside of the container 2 through the opening 5 together with the excess air. The only part of additive gaseous fluid utilized will be that actually admitted to the delivery duct 8 through the admission valve 6.

Alternatively, the outlet valve connector 125 can be directly connected to the delivery duct 8, upstream or downstream of the admission valve 6.

In this embodiment too, it is provided that in the spraying nozzle 10 together with the air enriched with the first additive gaseous fluid, at least one second additive gaseous fluid be also admitted according to a modality similar to that described with reference to FIGS. 1 and 2.

In greater detail, this second additive fluid preferably comprises at least one noble gas selected from the group consisting of argon, helium, neon, cryptom, xenon, radon having a higher electric conductivity than air. In the second additive fluid one or more inert gases may be also comprised the function of which is essentially that of diluting the air admitted to the delivery duct 8 and consequently causing thinning of those substances inevitably present in the air such as free oxigen for example, that are detrimental to the electrification of the paint particles.

In a preferential solution herein shown by way of example only, the second additive gaseous fluid is provided to consist of a mixture comprising nitrogen in an amount included between 75% and 85% and preferably corresponding to 80%, helium in an amount included between 10% and 15% and preferably corresponding to 5% and neon in an amount included between 0.5% and 3% and preferably corresponding to 2%.

Each of these gases is held in a corresponding feeding bottle 136, 137, 138, 139 that, upon interposition of a corresponding flow control valve 136*a*, 137*a*, 138*a*, 139*a*, is connected via a respective feeding duct 140, 141, 142, 143 to a mixing collector 144 disposed intermediate the admission valve 6 and delivery duct 8 and structurally similar to the mixing collector 14 described with reference to FIGS. 1 and 2.

The present invention attains the intended purposes.

Lowering of the dielectric constant induced in air through the enrichment process causes a decisive improvement in the painting yield and consequently a lower dispersion of powder paint in the environment in which working is carried out.

As a result, important advantages are achieved with reference both to problems connected with the setting up and servicing of the filtering installations for recovery of the paint dispersed in the work environment, and to the working times and quality of the obtained product.

In particular the paint dispersion in the surrounding atmosphere can be reduced to such a point that the need for receovery operations as in the known art is eliminated. Under this situation it is also eliminated the necessity of cleaning all ducts and surfaces in contact with the paint when the type and/or color of the paint being used need to be changed. The economic loss due to the non-recovery of the dispersed paint at all events will be much lower than the economic gains resulting from the elimination of the downtime periods necessary for carrying out the recovery operations and cleaning of the ducts.

Alternatively, the paint flow rate to the delivery duct could be remarkably increased if problems resulting from a greater paint dispersion in the surrounding atmosphere are accepted, in exchange for an important reduction in the working times for paint coating.

Referring particularly to the embodiment shown in FIGS. 3 to 5, it will be also noted that the production of additive gaseous fluid by air bubbling through the working liquid is advantageous both as regards operation and from an economic point of view, by virtue of the elimination or at least restriction in use of noble and/or inert gases which are rather expensive.

In fact it has been found that an air enrichment carried out by means of vapors grants the paint particles the property of feeling to a greater extent the electrostatic charges induced by said particles and of uniformly coating the whole workpiece, even those surfaces that are of difficult access such as the inner faces of polyhedric elements and the like. The above is an important advantage both with reference to manual painting and when painting is carried out in automated plants operating continuously and/or using robot apparatus, because in the latter case any necessity of carrying out manual finishing interventions at points not reached by paint is eliminated.

Advantageously the invention also applies to painting apparatus already in use to which nly simple adaptations are carried out, the additional costs of said adaptations being of little importance.

Obviously, modifications and variations may be made to the invention as conceived, all of them falling within the scope of the inventive idea characterizing it.

In particular, it is understood that the types of gas or vapors used as the first and second additive fluids may be different depending on different requirements and operating conditions.

What is claimed is:

1. A method for electrostatic coating of a workpiece with paint, comprising the following steps:

mixing with air a paint in the form of a powder consisting of a plurality of particles dispersed in air;

electrostatically charging the individual particles forming the powder paint by submitting the paint to an electric ionization field;

projecting the electrostatically-charged powdered paint against a workpiece (11) at the same time as said air is selected through a spraying nozzle (10);

enriching the air to be conveyed to the spraying nozzle (10) with at least a first additive gaseous fluid means for increasing the electrostatic charge induced on the paint particles by effect of the electric ionization field, said first additive gaseous fluid means comprising a noble gas selected from the group consisting of argon, neon, crypton, xenon, radon,

2. The method as claimed in claim 1, wherein said first additive gaseous fluid means is admitted to a delivery duct (8) communicating with the spraying nozzle (10), immediately after air and paint have been admitted to the delivery duct (8).

3. The method as claimed in claim 1, further comprising a step of conveying at least one second additive gaseous fluid mixed with said first additive gaseous fluid to the spraying nozzle (10).

4. The method as claimed in claim 1, wherein said first additive gaseous fluid means consists of helium gas.

5. The method as claimed in claim 4, wherein helium gas is introduced in an amount included between 10 g/h and 40 g/h.

6. The method as claimed in claim 4, wherein said helium gas is introduced according to a flow rate included between 1/100 and 1/300 of the air flow rate.

7. The method as claimed in claim 3, wherein said second additive gaseous fluid consists of nitrogen.

8. The method as claimed in claim 7, wherein nitrogen gas is introduced according to a flow rate between 1/150 and 1/20 of the air flow rate.

9. The method as claimed in claim 3, wherein said first gaseous fluid means and second additive gaseous fluid consist of helium and nitrogen respectively, which are introduced according to an overall flow rate included between 1/110 and 1/15 of the air flow rate, the helium flow rate being in the range of 1/5 to ½ of the nitrogen flow rate.

10. The method as claimed in claim 3, wherein said second additive gaseous fluid is selected from the group consisting of neon, ammonium fluoride and argon.

11. The method as claimed in claim 10, wherein said workpiece (11) is made of glass.

12. A method for electrostatic coating of a workpiece with paint, comprising the following steps:

mixing with air a paint in the form of a powder consisting of a plurality of particles dispersed in air;

electrostatically charging the individual particles forming the powder paint by submitting the paint to an electric ionization field:

projecting the electrostatically-charged powdered paint against a workpiece (11) at the same time as said air is ejected through a spraying nozzle (10);

enriching the air to be conveyed to the spraying nozzle (10) with at least a first additive gaseous fluid means for increasing the electrostatic charge induced on the paint particles by effect of the electric ionization field, said first additive gaseous fluid means being produced by submitting to bubbling at least a part of said air through at least one working liquid (115) arranged to generate the first additive fluid by evaporation.

13. The method as claimed in claim 12, wherein the working liquid (115) is selected from the group consisting of lactic acid, citric acid, formaldehyde, glacial acetic acid, propionic acid, oxalic acid, monochloroacetic acid, glycolic acid, tartaric acid, sulfamic acid.

14. The method as claimed in claim 12, wherein said working liquid (115) consists of a mixture lactic acid in the range of 60% to 80% and glacial acetic acid in the range of 20% to 40%.

15. The method as claimed in claim 12, wherein after the enrichment step and before the step of mixing air with powder paint, a step of drying said enriched air is performed.

16. The method as claimed in claim 12, wherein said enrichment step is performed by further conveying to the spraying nozzle (10) together with said air, at least one second additive gaseous fluid comprising at least one noble gas selected from the group consisting of argon, helium, neon, crypton, xenon, radon.

17. The method as claimed in claim 16, wherein said second additive gaseous fluid comprises nitrogen in an amount included between 80% and 85%, helium in an amount included between 10% and 15%, carbon dioxide in an amount included between 3% and 7% and neon in an amount included between 0.5% and 3%.

* * * * *